US007133823B2

(12) United States Patent
Gao

(10) Patent No.: US 7,133,823 B2
(45) Date of Patent: Nov. 7, 2006

(54) SYSTEM FOR AN ADAPTIVE EXCITATION PATTERN FOR SPEECH CODING

(75) Inventor: Yang Gao, Mission Viejo, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 685 days.

(21) Appl. No.: 09/761,033

(22) Filed: Jan. 16, 2001

(65) Prior Publication Data

US 2002/0123888 A1 Sep. 5, 2002

Related U.S. Application Data

(60) Provisional application No. 60/233,042, filed on Sep. 15, 2000.

(51) Int. Cl.
*G10L 21/02* (2006.01)
*G10L 19/12* (2006.01)
*G10L 19/08* (2006.01)
*G10L 19/06* (2006.01)

(52) U.S. Cl. ..... 704/223; 704/219; 704/224

(58) Field of Classification Search ..... 704/220, 704/222, 207, 216, 200, 229, 219, 218, 201, 704/223, 224; 395/2.16; 381/40
See application file for complete search history.

(56) References Cited

U.S. PATENT DOCUMENTS 5,265,167 A * 11/1993 Akamine et al. ..... 704/220
5,359,696 A * 10/1994 Gerson et al. ..... 704/223
5,495,555 A * 2/1996 Swaminathan ..... 704/207
5,687,284 A * 11/1997 Serizawa et al. ..... 704/222
5,719,993 A * 2/1998 Kleijn ..... 704/220
5,724,480 A * 3/1998 Yamaura ..... 704/219
5,752,223 A * 5/1998 Aoyagi et al. ..... 704/219
5,778,338 A * 7/1998 Jacobs et al. ..... 704/223
5,893,060 A * 4/1999 Honkanen et al. ..... 704/258
5,924,061 A * 7/1999 Shoham ..... 704/218
5,926,786 A * 7/1999 McDonough et al. ..... 704/224
5,966,689 A * 10/1999 McCree ..... 704/226
6,006,177 A * 12/1999 Funaki ..... 704/220
6,009,388 A * 12/1999 Ozawa ..... 704/223
6,014,622 A * 1/2000 Su et al. ..... 704/223
RE36,721 E * 5/2000 Akamine et al. ..... 704/220
6,169,970 B1 * 1/2001 Kleijn ..... 704/219
6,311,154 B1 * 10/2001 Gersho et al. ..... 704/219
6,470,310 B1 * 10/2002 Oshikiri et al. ..... 704/207
6,636,829 B1 * 10/2003 Benyassine et al. ..... 704/201
6,813,602 B1 * 11/2004 Thyssen ..... 704/222

(Continued)

OTHER PUBLICATIONS

Schroeder, M. Atal, B. "Code-Excited Linear Prediction (CELP): High-quality Speech at Very Low Bit Rates", Acoustics, Speech and Signal Processing, 1985, vol. 10, pp. 937-940.*

(Continued)

*Primary Examiner*—David Hudspeth
(74) *Attorney, Agent, or Firm*—Farjami & Farjami LLP

(57) ABSTRACT

There are provided short term enhancement methods and systems to improve perceptual quality in reproduced speech. According to one aspect, a method of enhancing a speech signal includes processing said speech signal to generate a plurality of frames, wherein each of said plurality frames includes a plurality of subframes, coding a previous subframe of said plurality of subframes using Code-Excited Linear Prediction to generate a previous excitation signal, and applying short term enhancement on said previous excitation signal to enhance a current excitation signal for a current subframe.

18 Claims, 6 Drawing Sheets

U.S. PATENT DOCUMENTS

2003/0182108 A1* 9/2003 Proctor et al. ..... 704/221

OTHER PUBLICATIONS

P. Kroon and W.B. Kleijn, Linear-Prediction based Analysis-by-Synthesis Coding, chapters 1-9, pp. 81-113.

W. Bastiaan Kleijn, Peter Kroon and Dror Nahumi, "The RCELP Speech-Coding Algorithm", vol. 5, No. 5, Sep.-Oct. 1994.

"Vector Quantization for Speech Transmission", p. 317.

Redwan A. Salami, "Binary Pulse Excitation: A Novel Approach to Low Complexity CELP Coding," Chapter 14, pp. 145, 148-149 and 152-153.

Akitoshi Kataoka, Takehiro Moriya, Jotaro Ikeda and Shinji Hayashi, "LSP and Gain Quantization for CS-ACELP Speech Coder," Special Feature ITU Standard Algorithm for 8-kbit/s Speech Coding, NTT Review, pp. 30, 32 and 34.

Erdal Paksoy, Alan McCree and Vishu Viswanathan, "A Variable-Rate Multimodal Speech Coder with Gain-Matched Analysis-By-Synthesis," Corporate Research, Texas Instruments, Dallas, TX, 0-8186-7919-0/97, 1997 IEEE, pp. 751-754.

Tomohiko Taniguchi, Yoshinori Tanaka and Robert M. Gray, "Speech Coding with Dynamic Bit Allocation (Multimode Coding)," Fujitsu Laboratories Ltd. and Information Systems Laboratory, Department of Electrical Engineering, Stanford University, Chapter 15, p. 157.

C. Laflamme, J-P Adoul, H.Y. Sue, and S. Morissette, "On Reducing Computational Complexity of Codebook Search in CELP Coder Through the Use of Algebraic Codes," Community Research Center, University of Sherbrooke, Sherbrooke, P.Q., Canada, J1K 2R1, pp. 177 and 179.

Chih-Chung Kuo, Fu-Rong Jean and Hsiao-Chuan Wang, "Speech Classification Embedded in Adaptive Codebook Search for Low Bit-Rate CELP Coding," IEEE Transactions on Speech and Audio Processing, vol. 3, No. 1, Jan. 1995, pp. 94, 96 and 98.

Tomohiko Taniguchi, Yoshinori Tanaka, and Yasuji Ohta, "Structured Stochastic Codebook and Codebook Adaptation for CELP," Fujitsu Laboratories, Ltd., 1015 Kamikodanaka, Nakahara-ku, Kawasaki 211, Japan, pp. 217-224.

Amitava Das, Erdal Paksoy and Allen Gersho, "Multimode and Variable-Rate Coding of Speech," Department of Electrical and Computer Engineering, University of California, Santa Barbara, CA 93106, USA, Chapter 7, pp. 257-288.

Ira A. Gerson and Mark A. Jasiuk, Vector Sum Excited Linear Prediction (VSELP), Chicago Corporate Research and Development Center, Motorola Inc., 1301 E. Algonquin Road, Schaumburg, IL 60196, Chapter 7, pp. 69-79.

Joseph P. Campbell, Jr., Thomas E. Tremain and Vanoy C. Welch, The DOD 4.8 KBPS Standard (Proposed Federal Standard 1016), U.S. Government, Department of Defense, Fort Mead, Maryland 20755-6000, USA, Chapter 12, pp. 121, 123, 125, 127, 129, 131, and 133.

Coding of Speech at 8 kbit/s using Conjugate-Structure Algebraic-Code-Excited Linear Predictive (CS-ACELP) Coding, Draft Recommendation G.729, Study Group 15 Contribution—Q.12/15, International Telecommunication Union Telecommunications Standardization Sector, Jun. 8, 1995, version 5.0, pp. i, iii pp. 1-41 (odd pages only).

W.B. Kleijn and K.K. Paliwal, "An Introduction to Speech Coding," Chapter 1, pp. 3-47.

* cited by examiner

SYSTEM FOR AN ADAPTIVE EXCITATION PATTERN FOR SPEECH CODING

CROSS REFERENCE TO RELATED APPLICATIONS

The present application claims the benefit of U.S. Provisional Application No. 60/233,042, filed Sep. 15, 2000, which is incorporated by reference herein.

U.S. patent application Ser. No. 09/663,242, "SELECTABLE MODE VOCODER SYSTEM,", filed on Sep. 15, 2000.

U.S. patent application Ser. No. 09/755,441, "INJECTING HIGH FREQUENCY NOISE INTO PULSE EXCITATION FOR LOW BIT RATE CELP,", filed on Sep. 15, 2000.

U.S. patent application Ser. No. 09/771,293, "SHORT TERM ENHANCEMENT IN CELP SPEECH CODING," , filed on Sep. 15, 2000.

U.S. patent application Ser. No. 09/761,029, "SYSTEM OF DYNAMIC PULSE POSITION TRACKS FOR PULSE-LIKE EXCITATION IN SPEECH CODING,", filed on Sep. 15, 2000.

U.S. patent application Ser. No. 09/782,791, "SPEECH CODING SYSTEM WITH TIME-DOMAIN NOISE ATTENUATION,", filed on Sep. 15, 2000.

U.S. patent application Ser. No. 09/782,383, "SYSTEM FOR ENCODING SPEECH INFORMATION USING AN ADAPTIVE CODEBOOK WITH DIFFERENT RESOLUTION LEVELS,", filed on Sep. 15, 2000.

U.S. patent application Ser. No. 09/663,837, "CODEBOOK TABLES FOR ENCODING AND DECODING,", filed on Sep. 15, 2000.

U.S. patent application Ser. No. 09/662,828, "BITSTREAM PROTOCOL FOR TRANSMISSION OF ENCODED VOICE SIGNALS,", filed on Sep. 15, 2000.

U.S. patent application Ser. No. 09/781,735, "SYSTEM FOR FILTERING SPECTRAL CONTENT OF A SIGNAL FOR SPEECH ENCODING,", filed on Sep. 15, 2000.

U.S. patent application Ser. No. 09/663,734, "SYSTEM OF ENCODING AND DECODING SPEECH SIGNALS,", filed on Sep. 15, 2000.

U.S. patent application Ser. No. 09/663,002, "SYSTEM FOR SPEECH ENCODING HAVING AN ADAPTIVE FRAME ARRANGEMENT,", filed on Sep. 15, 2000.

U.S. patent application Ser. No. 09/940,904, "SYSTEM FOR IMPROVED USE OF PITCH ENHANCEMENT WITH SUB CODEBOOKS,", filed on Sep. 15, 2000.

BACKGROUND OF THE INVENTION

1. Technical Field

This invention relates to speech communication systems and, more particularly, to systems for digital speech coding.

2. Related Art

One prevalent mode of communication is by communication systems that include both wireline and wireless radio systems. Data and voice transmissions within a wireless system occur within a bandwidth of an allowed frequency range. Due to increased wireless communication traffic, reduced bandwidth of transmissions to improve capacity with the system is desirable.

Voice and data are transmitted digitally in wireless telecommunications due to noise immunity, reliability, compactness of equipment, and the ability to implement sophisticated signal processing functions using digital techniques. One form of digital transmission is accomplished using digital speech processing systems. Waveforms representing analog speech signals are sampled and then digitally encoded. The number of bits of the encoded signal can be expressed as a bit rate that specifies the number of bits to describe one second of speech. Over the years, significant variations and enhancements have been applied to waveform matching techniques in an effort to improve the quality of the synthesized speech and increase the speech compression.

A reduction in the quality of the synthesized (or reconstructed) speech may occur with respect to the original speech. This divergence in the quality of the synthesized speech is due in part to the failure to closely replicate perceptual aspects of the original speech with the bits of data available to describe the signal. Poor replication of the perceptual aspects could result in noise, loss of clarity and the failure to capture recognizable characteristics such as tone, pitch and magnitude. These characteristics allow a listener to recognize who the speaker is, as well as providing other perception based features, such as, intelligibility and naturalness of the speech.

Accordingly, there is a need for systems of speech coding that are capable of minimizing the bandwidth of original speech, while providing synthesized speech that closely resembles the original speech and captures the perceptually important features of the speech.

SUMMARY

This invention provides a system for an improved excitation enhancement system that uses short term prediction to enhance the excitation signal. As speech data applications continue to operate in areas having intrinsic bandwidth limitations, the perceptual quality of reproduced speech data in typical speech coding systems suffers. The invention employs short term enhancement to improve perceptual quality in reproduced speech.

Speech coding systems may operate using communication media having limited or constrained bandwidth availability. Any communication media may be employed. Examples of such communication media include, but are not limited to, wireless communication media, wire-based telephonic communication media, fiber-optic communication media, and Ethernet.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

A system is provided that utilizes short term enhancement to enhance coded data that, when decoded, produces a synthesized speech signal that resembles an original speech sample. The system is typically used to enhance speech signals transmitted via a wireless radio telecommunications network. Mobile cellular standards, such as the Adaptive Multi-Rate (AMR) and Selectable Mode Vocoder (SMV) standards, define digital transmission in wireless radio telecommunications. An SMV system is utilized to describe the invention. However, those skilled in the art will appreciate that other systems could be used with the invention.

Figure 1:
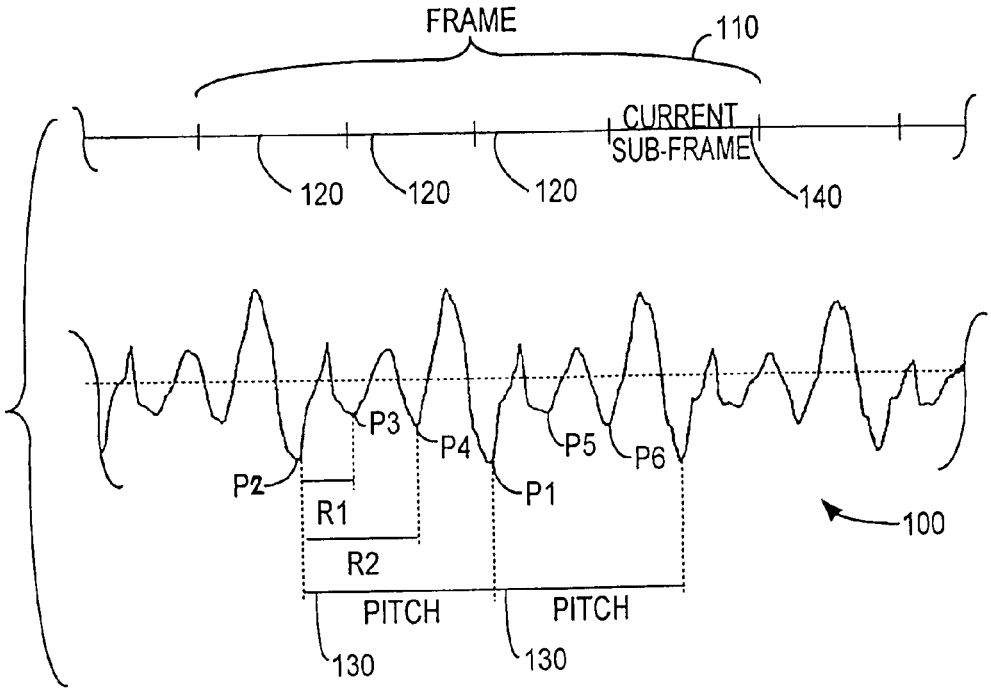
FIG. 1 is an illustration of a waveform illustrating an exemplary speech signal.

In FIG. 1, speech coding circuitry (also described in FIG. 2) utilizes prediction to separate a redundant part of a speech signal 100 from an excitation part of the signal 100. The redundant part of the speech signal 100 is an approximately periodic part of the speech signal 100 and the excitation part of the signal describes variations in the speech signal 100. The excitation part of the signal typically may be coded by an encoder and transmitted to a decoder to be converted into synthesized speech (the encoder and decoder are described in FIG. 3). The signals may be coded using a linear predictive coding (LPC) filter. A frame-based algorithm stores sampled input speech signals into blocks of samples called frames 110. An exemplary SMV system operates at a frame size of twenty milliseconds (ms) or one hundred sixty samples per frame. Other sized frames may be used. For signal processing purposes, the frames 110 may be divided into sub-frames 120 that are typically forty samples in size.

Short term enhancement may be used to enhance the excitation signal per sub-frame 120. Short term enhancement utilizes pitch lag information to enhance the excitation signal. Pitch 130 is the approximately periodic part of the speech signal 100, and lag is a measure of the pitch delay in samples. The general shape of the speech signal 100 evolves relatively slowly as a function of time, facilitating pitch prediction and interpolation. By determining information of lag and gain of a sample from a past sub-frame, the information can be scaled and added to a current sub-frame 140 to enhance the limited amount of data generally used to describe the signal for the current sub-frame 140. Thus, a first approximation of the excitation for peak P1 in the current sub-frame 140 is advantageously determined using a scaled segment of the previously sampled value for peak P2. Short term enhancement, further described below with regard to FIG. 6, samples signals within the pitch 130 of a previous sub-frame to approximate corresponding excitation signals in the current sub-frame 140.

Figure 2:
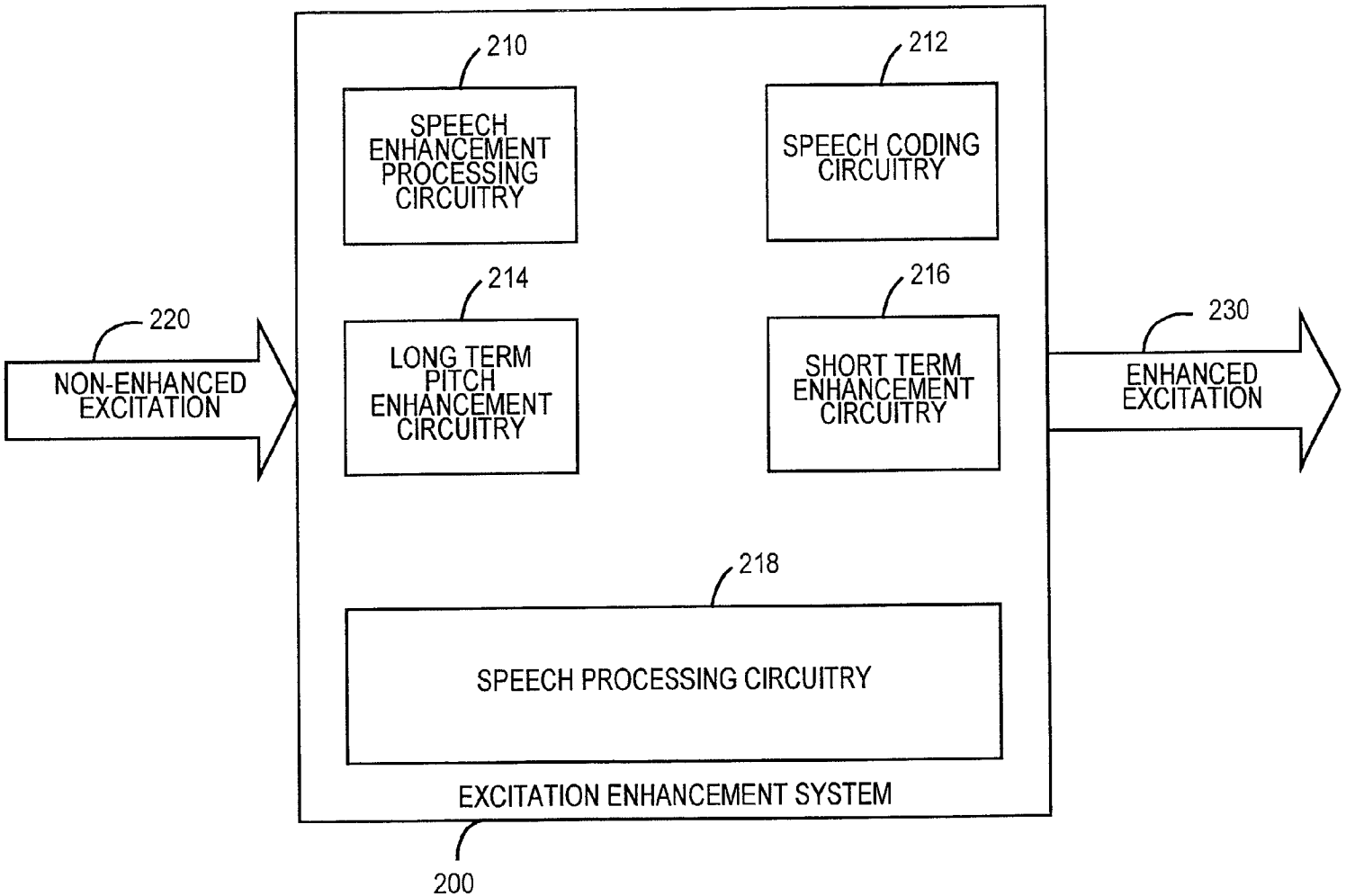
FIG. 2 is a block diagram illustrating one embodiment of a speech excitation enhancement system.

FIG. 2 shows a system diagram illustrating one embodiment of an excitation enhancement system 200. The excitation enhancement system 200 may include, among other things, speech enhancement processing circuitry 210, speech coding circuitry 212, long term enhancement circuitry 214, short term enhancement circuitry 216, and speech processing circuitry 218. The speech coding circuitry 212 can include fixed and adaptive codebooks as are known in the art. The speech excitation enhancement system 200 operates on non-enhanced excitation 220 and generates enhanced excitation 230. The speech excitation enhancement system 200 is implemented, for example, on one or more integrated circuits (IC), digital signal processors (DSP) or general processors.

Figure 3:
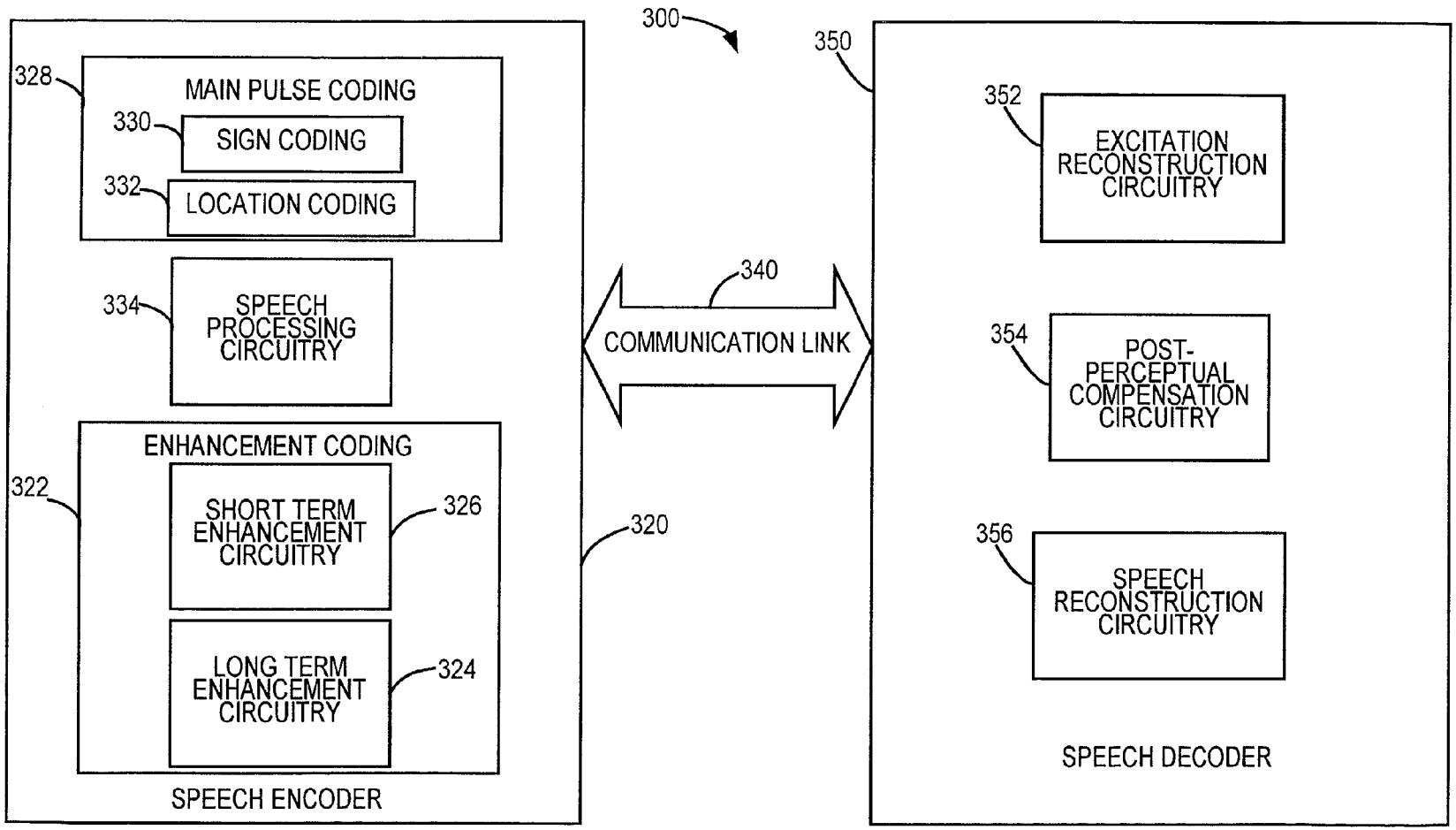
FIG. 3 is a block diagram illustrating one embodiment of a speech codec that employs excitation enhancement.

FIG. 3 shows exemplary speech coding circuitry (e.g., speech coding circuitry 212 from FIG. 2) that utilizes enhancement coding 322 at the encoder 320 to perform short term excitation enhancement and long term pitch prediction. A system diagram 300 illustrates one embodiment of a speech codec (e.g., IC with encoder/decoder) that employs speech enhancement in accordance with the invention. A speech encoder 320 of the speech codec 300 performs enhancement coding 322. The enhancement coding 322 is performed using both long term enhancement circuitry 324 and short term enhancement circuitry 326. The enhancement coding 322 generates prediction and enhancement within the speech sub-frame 120.

The speech encoder 320 of the speech codec 300 also may perform main pulse coding 328 of the speech signal 100 including both sign coding 330 and location coding 332 within the speech sub-frame 120, FIG. 1. Speech processing circuitry 334 also is employed within the speech encoder 320 of the speech codec 300 to assist in speech processing using methods known to those having skill in the art to operate on and perform manipulation of speech data. The speech data, after having been processed, at least to some extent by the speech encoder 320 of the speech codec 300 is transmitted via a communication link 340 to a speech decoder 350 of the speech codec 300. The communication link 340 may be any communication media capable of transmitting voice data, including but not limited to, wireless communication media, wire-based telephonic communication media, fiber-optic communication media, and Ethernet.

The speech decoder 350 of the speech codec 300 may include, among other things, excitation reconstruction circuitry 352, post perceptual compensation circuitry 354, and speech reconstruction circuitry 356. In certain embodiments, the transmit speech processing circuitry 334 and the receiver speech processing circuitry 356 operate cooperatively on the speech data within the entirety of the speech codec 300. Alternatively, the transmit speech processing circuitry 334 and the receiver speech processing circuitry 356 may operate independently on the speech data, each serving individual speech processing functions in the speech encoder 320 and the speech decoder 350, respectively.

The speech processing circuitry 334 and 356 and the main pulse coding circuitry 328 may include, but are not limited to, circuitry and associated algorithms known to those of skill in the art of speech coding. Examples of such main pulse coding circuitry 328 include Code-Excited Linear Prediction (CELP), eXtended CELP (eX-CELP), algebraic CELP and pulse-like excitation. An example of an eX-CELP based speech coder system is described in commonly assigned U.S. patent Application, "SYSTEM OF ENCODING AND DECODING SPEECH SIGNALS," by Yang Gao, Adil Beyassine, Jes Thyssen, Eyal Shlomot and Huan-Yu Su, previously incorporated by reference.

Figure 4:
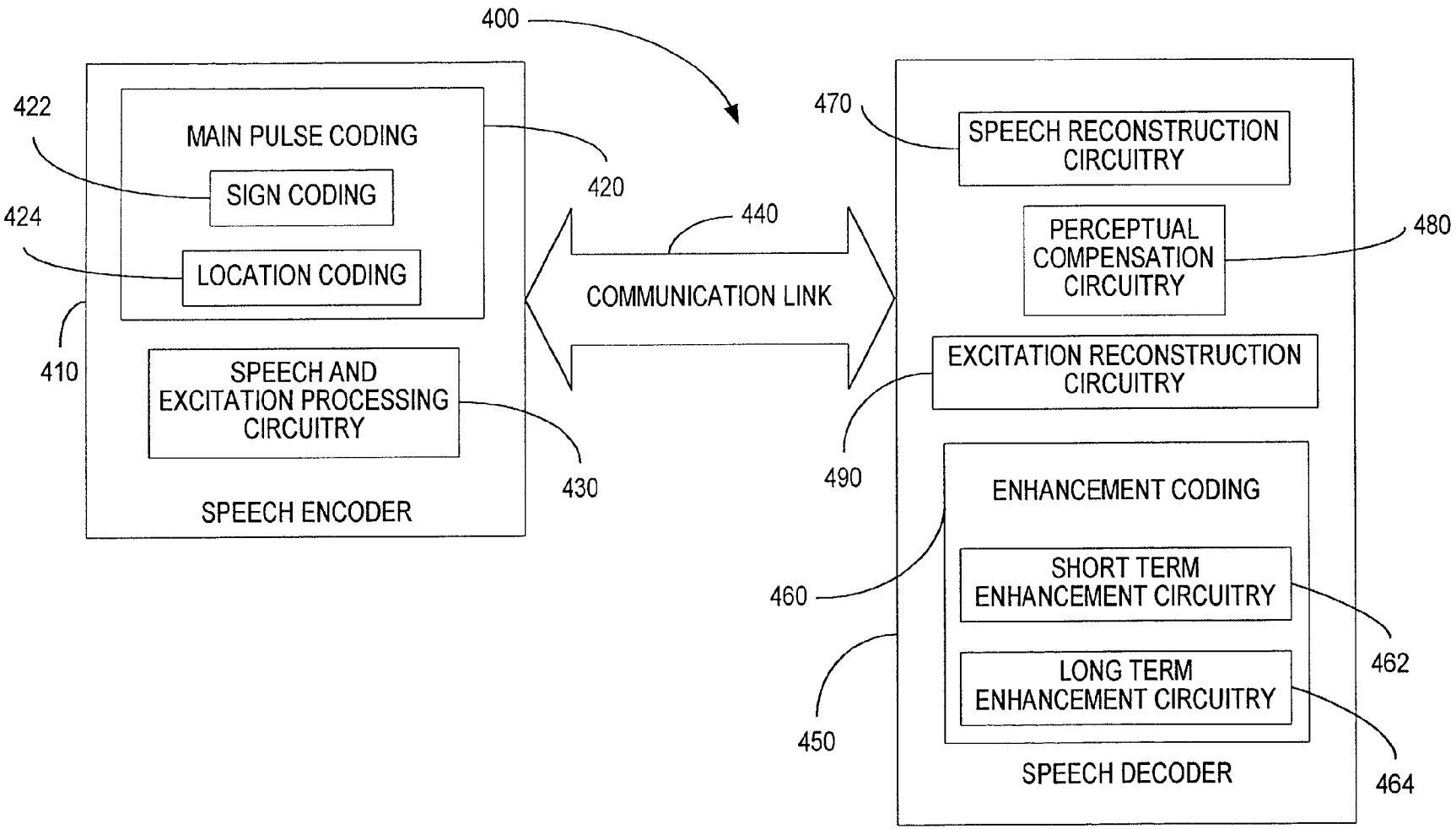
FIG. 4 is a block diagram illustrating another embodiment of a speech codec that employs excitation enhancement.

FIG. 4 illustrates a system diagram of another embodiment of a speech codec 400 that employs excitation enhancement at the speech decoder 450 in accordance with the preferred embodiments. Because the excitation enhancement is performed using data from past sub-frames 120, FIG. 1, the enhancement is accomplished without increasing bandwidth. The speech encoder 410 of the speech codec 400 performs main pulse coding 420 of the speech signal 100 including both sign coding 422 and location coding 424 within the speech sub-frame 120. Speech and excitation processing circuitry 430 also may be employed within the speech encoder 410 of the speech codec 400 to assist in speech processing using methods known to those having skill in the art to operate on and perform manipulation of speech data, examples of which have been previously identified.

The speech data, after having been processed, at least to some extent by the speech encoder 410 of the speech codec 400 may be transmitted via a communication link 440 to a speech decoder 450 of the speech codec 400. The speech decoder 450 of the codec 400 performs excitation enhancement coding 460. The enhancement coding 460 may be performed using both long term enhancement circuitry 462 and short term enhancement circuitry 464. In other embodiments, only short term enhancement is performed. The enhancement coding 460 generates prediction and enhancement within the speech sub-frame 120. The speech decoder 450 of the speech codec 400 may also contain speech reproduction circuitry 470, post perceptual compensation circuitry 480, and excitation reconstruction circuitry 490.

Figure 5:
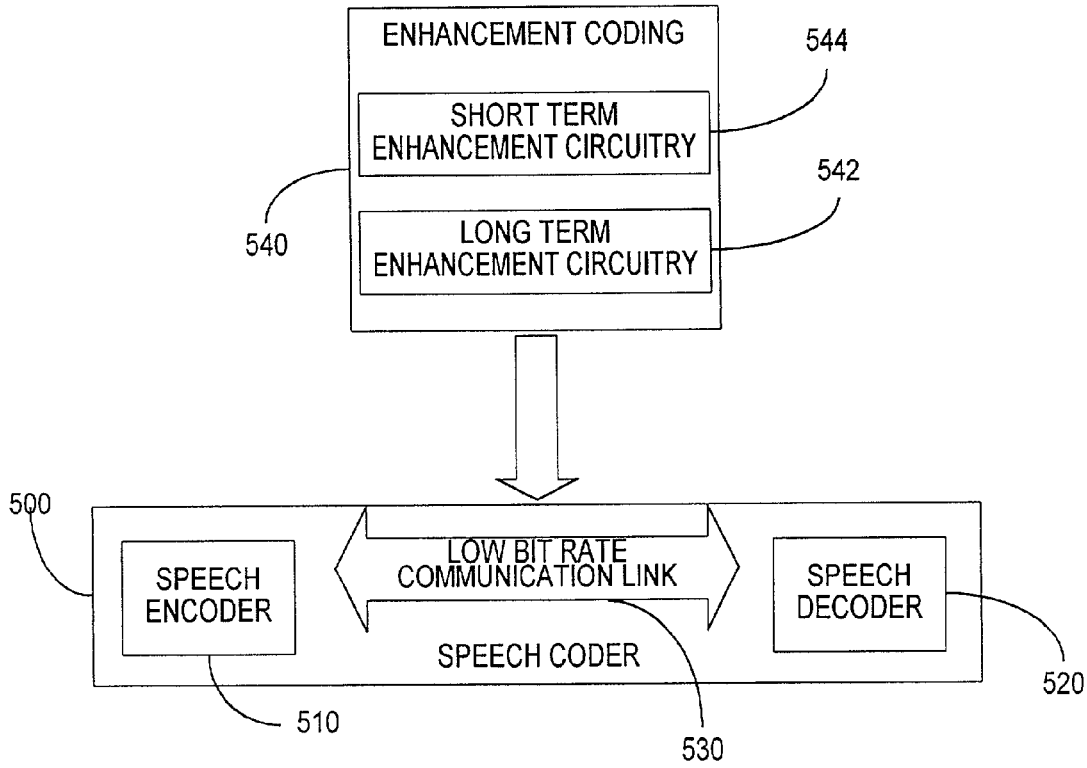
FIG. 5 is a block diagram illustrating one embodiment of an integrated speech codec that employs excitation enhancement.

FIG. 5 is a system diagram that illustrates another embodiment of an integrated speech codec 500 that employs speech and excitation enhancement. The integrated speech codec 500 may contain, among other things, a speech encoder 510 that communicates with a speech decoder 520 via a low bit rate communication link 530. The low bit rate communication link 530 may be any communication media capable of transmitting voice data, including but not limited to, wireless communication media, wire-based telephonic communication media, fiber-optic communication media, and Ethernet.

Excitation enhancement coding 540 is performed in the integrated speech codec 500. The enhancement coding 540 may be performed using, among other things, both long term enhancement circuitry 542 and short term enhancement circuitry 544. The long term enhancement circuitry 542 and the short term enhancement circuitry 544 operate cooperatively in certain embodiments, and independently in other embodiments. As shown, the long term enhancement circuitry 542 and short term enhancement circuitry 544 may be arranged within the entirety of the integrated speech codec 500. Depending on the specific application at hand, a user can select to place the long term enhancement circuitry 542 and short term enhancement circuitry 544 in only one or both of the speech encoder 510 and the speech decoder 520. Various embodiments are envisioned, without departing form the scope and spirit of the invention, to place various amounts of the long term enhancement circuitry 542 and the short term enhancement circuitry 544 in the speech encoder 510 and the speech decoder 520. For example, a predetermined portion of the short term enhancement circuitry 544 may be placed in the speech encoder 510 and the remaining portion of the short term enhancement circuitry 544 may be placed in the speech decoder 520.

Figure 6:
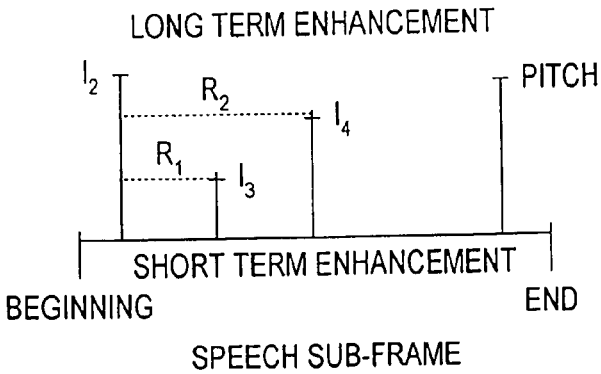
FIG. 6 is a diagram illustrating a speech sub-frame depicting excitation enhancement.

FIGS. 1 and 6 illustrate short term enhancement of the invention. Short term enhancement uses the previous excitation signal to enhance the excitation signal of the current sub-frame 140. The past excitation, weighted by a current weighting filter, may be used to estimate correlation peaks at a distance within the current sub-frame 140. Those skilled in the art will appreciate that an algorithm, similar to that used for long term prediction of pitch lag, can be used to estimate short term correlation of the speech signal 100. In one embodiment, to evaluate short term correlation of the speech signal 100, typically less than five peaks and gains per sub-frame 120 are determined from the past excitation. Those skilled in the art will appreciate that more or less correlation peaks and gains can be determined, depending on the application.

FIG. 6 illustrates a diagram of two pulses I3 and I4 shown at distances R1 and R2 from pulse I2, which correlate to peaks P3, P4 and P2, respectively on FIG. 1. I2 indicates the main pulse, I3 and I4 indicate pulses generated by short term enhancement and Pitch indicates a pulse generated by long term enhancement or short term enhancement where the true pitch lag is incorrectly determined. The excitation pattern P(n) is constructed as $$P(n) = C\sum_i Gi \cdot \delta(n - Ti) + \delta(n),$$

where Gi is the gain and Ti is the distance for the ith peak. Regarding FIG. 6, $T_0$ could equal R1, $T_1$ could equal R2 and $T_N$ could equal the distance from the main pulse I2 to Pitch. $G_0$, $G_1$ and $G_N$ can correspond to the magnitudes of I3, I4 and Pitch respectively. The gains Gi and the distance Ti may be determined using methods know to those skilled in the art of speech processing. Gains and distances can be calculated, for example, by maximizing correlations of past synthesized signals in a weighted speech domain. The value C is a coefficient typically between 0 and 0.5, and may be a constant or an adaptive value related to the stability of the speech signal. P(n) accounts in part for the fact that the excitation pattern may cover a long term correlation in which the true pitch lag is shorter than the sub-frame size, while the detected pitch lag may be double or triple the true pitch lag.

Figure 7:
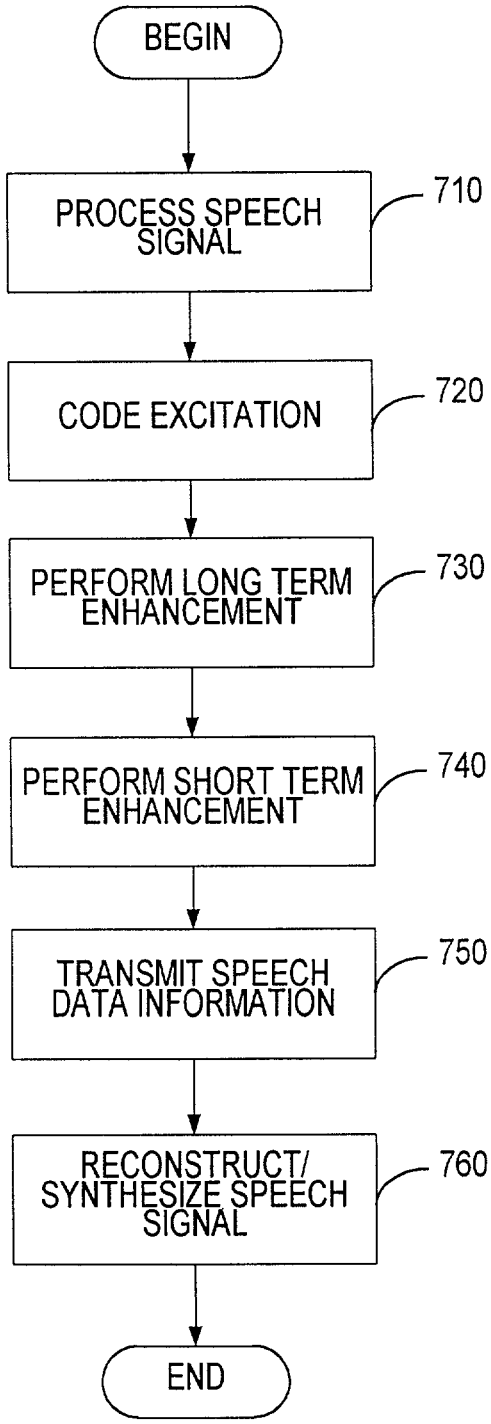
FIG. 7 is a functional block diagram illustrating an embodiment of this invention that generates short term enhancement.

FIG. 7 is a functional block diagram illustrating an embodiment that generates long term and short term excitation enhancement. In a block 710, a speech signal 100 is processed. In a block, 720, an excitation is coded. In block 730, long term enhancement is performed, and in a block 740, short term enhancement is performed. Additional pulses to the current excitation, as determined by the short term enhancements can be added to the excitation by performing a convolution operation of the excitation pattern P(n) with excitation signals, for example, from a fixed codebook of the speech coding circuitry 512, as known to those of skill in the art. In a block 750, the speech data information is transmitted via a communication link. In a block 760, the speech signal is reconstructed/synthesized.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A method of encoding a speech signal, said method comprising:

processing said speech signal to generate a plurality of frames, wherein each of said plurality frames includes a plurality of subframes;

coding a previous subframe of said plurality of subframes using Code-Excited Linear Prediction to generate a previous excitation signal; and applying short term enhancement using said previous excitation signal to enhance a current excitation signal for a current subframe;

wherein said current excitation signal is constructed using $$P(n) = C\sum_i Gi \cdot \delta(n - Ti) + \delta(n),$$

where Gi is a gain, Ti is a distance for an ith peak, and C is a coefficient, wherein Ti is smaller than pitch period.

2. The method of claim 1, wherein said short term enhancement is achieved by using several pulses from said previous excitation signal to generate one or more short term enhancement pulses based on short term correlation.

3. The method of claim 1, wherein said short term enhancement is achieved by weighting said previous excitation signal by a current weighting filter to estimate correlation peaks at a distance.

4. The method of claim 3, wherein said short term enhancement determines less than five peaks and gains per each sub-frame from said previous excitation signal.

5. The method of claim 1, wherein gains and distances are calculated by maximizing correlations of previous excitation signals in a weighted speech domain.

6. The method of claim 1, wherein short term enhanced excitation is generated by performing a convolution operation of P(n) with said excitation signal.

7. The method of claim 1, wherein said current excitation signal is constructed using an excitation pattern that accounts for a long term correlation in which a true pitch lag is shorter than a subframe size, while detected pitch lag is substantially greater than the true pitch lag.

8. An encoder for encoding a speech signal, said encoder comprising:

a speech processing circuitry configured to process said speech signal to generate a plurality of frames, wherein each of said plurality frames includes a plurality of subframes;

a coding circuitry configured to code a previous subframe of said plurality of subframes using Code-Excited Linear Prediction to generate a previous excitation signal; and a short term enhancement circuitry configured to apply short term enhancement using said previous excitation signal to enhance a current excitation signal for a current subframe;

wherein said current excitation signal is constructed using $$P(n) = C\sum_i Gi \cdot \delta(n - Ti) + \delta(n),$$

where Gi is a gain, Ti is a distance for an ith peak, and C is a coefficient, wherein Ti is smaller than pitch period.

9. The encoder of claim 8, wherein said short term enhancement is achieved by using several pulses from said previous excitation signal to generate one or more short term enhancement pulses based on short term correlation.

10. The encoder of claim 8, wherein said short term enhancement is achieved by weighting said previous excitation signal by a current weighting filter to estimate correlation peaks at a distance.

11. The encoder of claim 10, wherein said short term enhancement determines less than five peaks and gains per each sub-frame from said previous excitation signal.

12. The encoder of claim 8, wherein gains and distances are calculated by maximizing correlations of previous excitation signals in a weighted speech domain.

13. The encoder of claim 8, wherein short term enhanced excitation signal is generated by performing a convolution operation of P(n) with said excitation signal.

14. The encoder of claim 8, wherein said current excitation signal is constructed using an excitation pattern that accounts for a long term correlation in which a true pitch lag is shorter than a subframe size, while detected pitch lag is substantially greater than the true pitch lag.

15. A method of encoding a speech signal, said method comprising:

processing said speech signal to generate a plurality of frames, wherein each of said plurality frames includes a plurality of subframes;

coding a previous subframe of said plurality of subframes using Code-Excited Linear Prediction to generate a previous excitation signal;

determining information of lag and gain from said previous subframe;

scaling said information to generate a scaled information of said previous subframe; and applying said scaled information of said previous subframe to a current excitation signal for a current subframe to enhance data used to code said current excitation signal for said current subframe;

wherein said current excitation signal is constructed using $$P(n) = C\sum_i Gi \cdot \delta(n - Ti) + \delta(n),$$

where Gi is a gain, Ti is a distance for an ith peak, and C is a coefficient, wherein Ti is smaller than pitch period.

16. The method of claim 15, wherein said applying adds said scaled information to said current excitation signal for said current subframe.

17. The method of claim 15, wherein said scaling generates said scaled information of said previous excitation signal for a previous peak in said previous subframe, and said applying uses said scaled information to determine a first approximation of said current excitation signal for a current peak in said current subframe.

18. The method of claim 17, wherein said applying adds said scaled information to said current excitation signal for said current peak in said current subframe.

* * * * *